United States Patent [19]

Reeder, Jr.

[11] 4,106,720

[45] Aug. 15, 1978

[54] EXPANDABLE INTERNAL CHUCK

[76] Inventor: George Elwood Reeder, Jr., 10739 Mississippi Blvd., Coon Rapids, Minn. 55433

[21] Appl. No.: 747,464

[22] Filed: Dec. 3, 1976

[51] Int. Cl.[2] ..... B65H 75/24

[52] U.S. Cl. ..... 242/68.4; 242/72 R; 279/6

[58] Field of Search ..... 242/68–68.4, 242/72 R; 279/2 R, 2 A, 6; 269/48.1

[56] References Cited

U.S. PATENT DOCUMENTS

| | | | |
|---|---|---|---|
| 1,673,444 | 6/1928 | Derry | 242/72 R |
| 1,960,227 | 5/1934 | Krissiep | 242/72 R X |
| 2,920,894 | 1/1960 | Kreinick | 279/6 X |
| 3,419,227 | 12/1968 | Werkmeister et al. | 242/72 R |
| 3,768,749 | 10/1973 | Fredrickson | 242/72 R |

*Primary Examiner*—Harvey C. Hornsby
*Assistant Examiner*—John M. Jillions
*Attorney, Agent, or Firm*—Henry C. Kovar

[57] ABSTRACT

A expandable internal chuck for holding an item is disclosed and has an internal hub adopted to be mounted on a machine, a hub bearing having an axis at an acute oblique angle to the axis of the hub, a sleeve rotatably mounted on the hub bearing and having an internal journal positioned at an acute oblique angle to a sleeve exterior surface, the sleeve is rotatable on the hub bearing from a first position in which the sleeve exterior is concentric to the hub axis to a second position in which the sleeve exterior is at an acute oblique angle to the hub axis and in which the chuck is expanded; also disclosed is a detent and stop mechanism for aligning the sleeve with the hub.

28 Claims, 7 Drawing Figures

EXPANDABLE INTERNAL CHUCK

BACKGROUND OF THE INVENTION

1. Field of the Invention

This invention pertains to an expandable internal holding chuck.

2. The Prior Art

Prior art internal chucking devices are typically of an expanding wedge, internal cam, i.e. a hexagonal internal cam and six, radial expanding followers that the hexagonal cam forces outwards, or of some other multi-jaw structure. These devices usually have many mechanical components and as a result thereof have many crevices exposed to the exterior and open to dirt, chemicals, dust, debris and the like when in use. The prior art chucks when used on horizonal axis equipment, examples of which are tension or drive shafts for rolls of paper, steel and other bulk rolled sheet material, are typically characterized by not being able to concentrically chuck a heavy roll suspended on the chuck. The reason for this characteristic is that because of the tremendous roll weight, the roll drops upon the top of the chuck and when the chuck is tightened up, the top teeth or cams in the chuck are firmly engaged by the roll and what were the bottom teeth or cams are loose. These teeth or cams are also referred to as jaws in the trade. After tightening of the just described prior art chucks, when the roll is turned about the axis of the chuck, the roll runs eccentrically.

Further, because of the complexity of prior art chucks, maintenance is considered to be a considerable problem, particularly in the paper industry.

Another disadvantage, or limiting factor may be more appropriate, is that an increased contact area between the chuck and the item being chucked has been desired in order to preclude the chuck from turning in or distorting the inside of the item being chucked.

OBJECTS OF THE INVENTION

Accordingly, it is an object of the present invention to provide a simplified construction of internal chuck.

It is an object of the present invention to provide an internal chuck of greater strength than existing devices of comparable size.

It is an object of the present invention to provide an internal chuck which will concentrically hold an item when loaded and used along a horizontal axis.

It is an object of the present invention to provide an internal chuck having a sealed expansion mechanism.

A further object of the present invention is to provide an internal chuck of great simplicity which requires very little maintenance.

It is a most specific object of this invention to provide a vastly improved chuck for use between a tensioning device and a roll of sheet material to be unrolled off the tensioning device.

SUMMARY OF THE INVENTION

According to the principles of the present invention, a chucking device is provided having an internal hub with a radial bearing having an axis acutely oblique to an axis of the hub, a sleeve having an internal journal positioned acutely oblique to the external surface of such sleeve with the journal being rotatably fitted on the bearing; the sleeve is rotatable on the bearing between a first position concentric to the hub axis and a second position acutely oblique to the hub axis in which second position the chuck is effectively expanded.

IN THE DRAWINGS

AS SHOWN ON THE DRAWINGS

Figure 1:
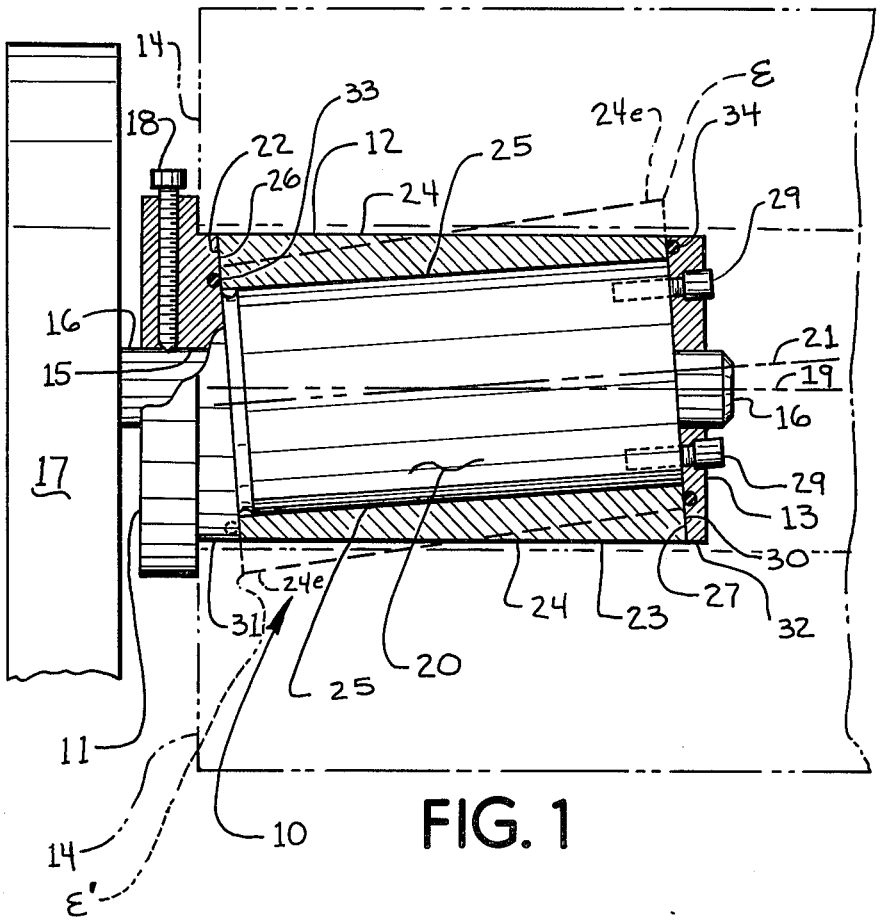
FIG. 1 is an elevational side view, partially schematic, and partially in section, of the preferred embodiment of the structure of an internal chuck provided in accordance with the principles of the present invention.

The principles of the present invention are particularly useful when embodied in a chucking device of the type illustrated in FIG. 1 and generally included by the numeral 10. The chucking device 10 includes a hub 11, a sleeve 12 rotatably mounted on the hub 11 and a retainer 13 which holds the hub 11 and sleeve 12 together. The chuck 10 is shown holding a roll of paper 14.

The hub 11 has an internal bore 15 through which a shaft 16 of a machine 17 is received. There is a set screw 18 securing the hub 11 to the machine shaft 16. It will be apparent that the hub 11 can be bolted to a machine, have a taper shaft, or be on a splined shaft, or utilize any other well known means for being mounted to the machine 17. The hub 11 has a central axis 19 about which the hub 11 is intended to be rotatable. The central axis 19 coincides with the center line of the machine shaft 16. There is a bearing surface 20 on the hub 11 and this bearing surface 20 is cylindrical and as such has an axis shown as the line 21. There is an axial thrust surface 22 on hub 11 which is at an acute oblique angle to the hub axis 19. The bearing surface 20 and axis 21 are perpendicular to the thrust surface 22.

There is a tubular sleeve or collar 23 which is rotatably mounted to the hub 11 as will be described. The sleeve 23 is an elongate member and has a round cylindrical outer surface 24, an internal journal 25 which is rotatably mounted on the bearing surface 20 and a pair of axial end surfaces 26, 27. The sleeve journal 25 is a round cylindrical bore and has an axis which is at an acute oblique angle to an axis of the sleeve outer surface 24. As shown in FIG. 1, the sleeve 23 and hub 11 are in a position, with respect to each other, which is considered the non-expanded position. In this non-expanded position the axis of the journal 25 is coincident with the bearing surface axis 21 and the axis of the sleeve outer surface 24 is coincident with the hub central axis 19. When the sleeve 23 is in this non-expanded position, the outer surface 24 is concentric with the hub axis 19.

A retainer 13 is mounted on the end of bearing surface 20 and is held to the hub 11 by fasteners 29. The retainer 13 has a axial thrust surface 30 which faces against the sleeve outer end 27. Each of the thrust surfaces 22, 30 are perpendicular to the bearing axis 21 and each of the sleeve ends 26, 27 are also perpendicular to the bearing axis 21. The most economical and strongest bearing surface 20 is formed as the surface of an integral portion of the material forming the entirety of the hub 11, but for extreme requirements of precision, known ball or roller bearings (not shown) could be utilized between the hub 11 and the sleeve 12.

Figure 2:
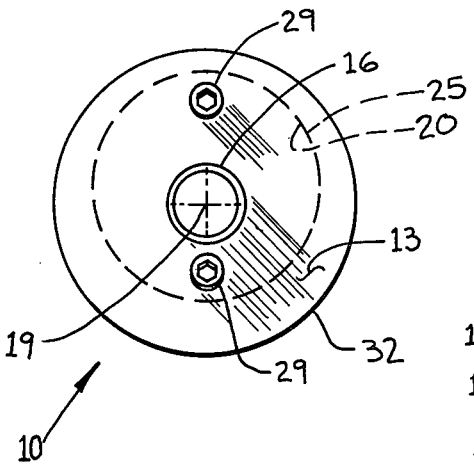
FIG. 2 is an end view of the structure of FIG. 1.

There is a radial shoulder 31 on the hub 11 which is axially adjacent to the sleeve end 26. The retainer 13 has a radial shoulder 32 which is adjacent to the sleeve end 27. The radial shoulders 31, 32 are both concentric to the hub axis 19 as well as to the sleeve outer surface 24 when the sleeve 12 is in the previously mentioned non-expanded position. At least one and preferably both of the radial shoulders 31, 32 are substantially of the same diameter as is the sleeve outer surface 24. FIG. 2 clearly shows an end view of the chuck 10 with the sleeve 12 being in the previously described non-expanded position.

Figure 3:
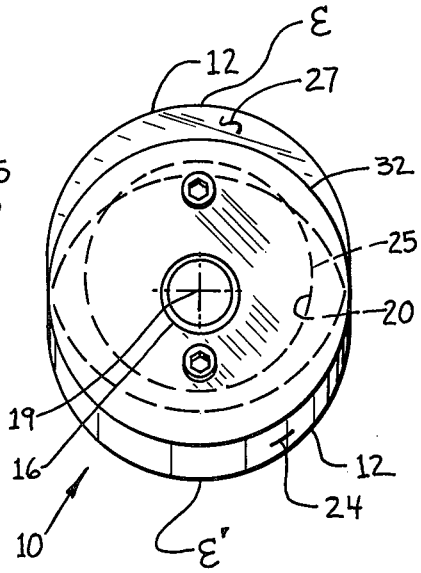
FIG. 3 is another end view of the structure of FIG. 1, however in FIG. 3 the chuck is expanded.

To expand the effective outer or chucking diameter of the chuck 10, the sleeve 12 is rotated with respect to the hub 11 and the sleeve outer surface 24 assumes a position which is acutely oblique to the hub axis 19. An end view of these relative positions is clearly shown in FIG. 3 and oblique and expanded positions of the sleeve outer surface 24 are indicated as **24*e* in both FIGS. 1 and 3. The sleeve 12 may rotate from the non-expanded position to the expanded position in either of a clockwise or counterclockwise direction of rotation with respect to the hub 11. As shown in FIG. 1, the internal diameter of the paper roll 14, and this paper roll 14 may be any other item such as a casting or piece of pipe having an internal bore, is greater than the non-expanded diameter of the chuck 10 but is less than the expanded diameter to which the chuck 10 will expand when the sleeve 12 rotates with respect to the hub 11. Therefore, the sleeve 12 will rotate until the outer surface 24 physically intercepts the roll or item 14 and then will wedge against the item 14 and tighten the chuck to the item 14**.

It will be appreciated that it is desirable to grasp the item 14 and locate it as concentric to the hub 11 as is possible. It has been found that if the sleeve 12 has a length which is greater than the diameter of the sleeve outer surface 24, that the chuck 10 is most accurate in concentrically locating the item 14. Further, another structural feature contributing to the extreme accuracy of this chuck 10 is the geometry of the sleeve 12 with respect to the hub 11. The axis 19 of the hub 11 and the axis 21 of the bearing surface 20 intersect precisely at the axial mid-point along the length of the bearing surface 20; in other words the axis 19 and 21 intersect at a point half way between the thrust surfaces 22 and 30. In the geometry of the sleeve 12, the axis of the journal, also indicated by 21, intersects with the sleeve outer surface 24 axis, indicated by 19, at the axial mid-point along the length of the sleeve 12. With this specific geometry of construction, the point of expansion E and E′ are precisely the same distance from the hub axis 19 which also represent the axis about which the chuck 10 is intended to be rotatable.

The chuck 10 is ideally suited for use in hostile environments of dust, dirt, chemical agents, grinding compounds and the like. The interrotating bearing surface 20 and journal surface 25 are well protected by a pair of seals 33 and 34 which preferably are at each end of the sleeve 12 and are positioned to contact against the sleeve end surfaces 26, 27 thereby providing the maximum length for the bearing surface 20.

Figure 4:
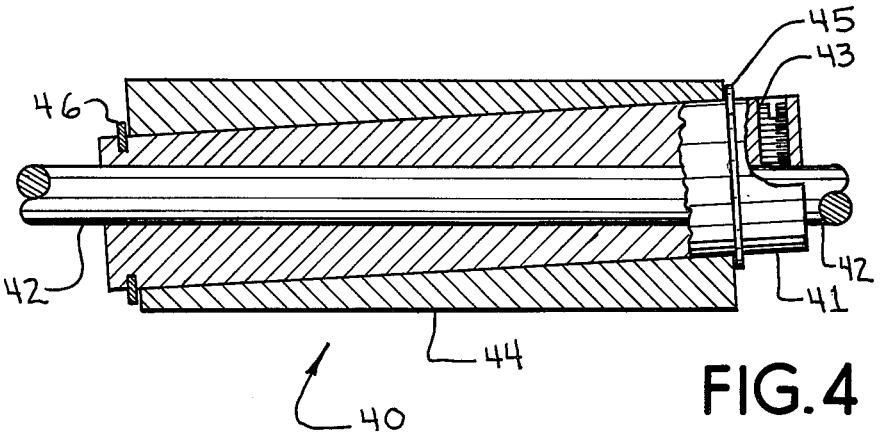
FIG. 4 is an elevational, partially in section, view of an alternative construction of the present invention.

FIG. 4 illustrates an alternative construction of a chuck 40 in accordance with this invention. The chuck 40 has a hub 41 fastened to a shaft 42 by a set screw 43. There is a sleeve 44 mounted on the exterior of the hub 41 and the sleeve 44 is retained on to the hub 41 by a pair of retainer rings 45 and 46. The construction and operative geometry of chuck 40 is identical to that previously described with respect to the chuck 10.

The chuck 40 offers an advantage in economy over the chuck 10 as the hub 41 is a single length of elongate round bar stock material of the same diameter as its bearing surface and the retainer rings 45 and 46, which are concentric to each other and to the outer surface of the hub 41, are placed in a pair of turned retainer ring grooves.

Figure 5:
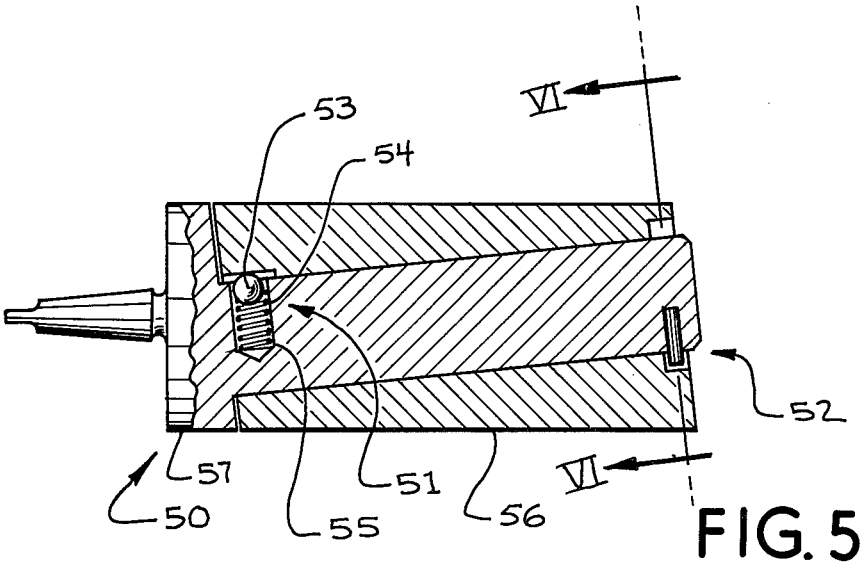
FIG. 5 is an elevational, partially in section view of another construction of the present invention having therein additional features.

FIG. 5 illustrates a chuck 50 of construction geometrically and operatively similar to the chuck 10 of FIG. 1. The chuck 50 has therein a detent mechanism 51 and a stop mechanism 52 for purposes to be explained.

It was previously explained with respect to the chuck 10 that the sleeve 12 has a non-expanded position. There is only one such position and it is necessary that the sleeve be in this position when an item is to be placed upon the chuck. The detent mechanism 51, shown having a ball 53 which is resiliently loaded by a spring 54 into a recess 55 in the sleeve 56, is operative to locate the sleeve 56 in the non-expanded position with respect to the hub 57. When an item is then placed upon the chuck 50, the sleeve 56 will not turn on the hub 57 until a predetermined torque is applied between the hub 57 and sleeve 56. This torque can be initiated either by starting up a machine or spinning an item on the chuck 50. This detent mechanism 51 greatly improves the usability of the chuck 50 by making it easy to load or or unload with an item.

The stop mechanism 52 serves another and different function and that is to prevent the sleeve 56 from turning past the position of maximum expansion and returning to the non-expanded position and so on which means continued rotation of the sleeve 56. It is necessary to preclude over center travel of the sleeve 56 when very soft or elastic items are grasped on the chuck. A specific example of such a soft item would be toilet paper rolls.

Figure 6:
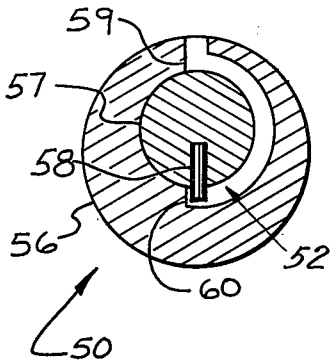
FIG. 6 is an end view in section taken along lines VI—VI of FIG. 5.

The stop mechanism 52 shown in section in FIG. 6 includes a pin 58 forming a fixed abutment and a groove having a first abutment 59 and a second abutment 60. The pin 58 actually has an abutment on each side. As seen in FIG. 6, when the sleeve 56 turns counterclockwise, the abutment 60 will engage against a first side of the pin 58 and prevent the sleeve 56 from turning past the non-expanded position. When the sleeve 56 is turned clockwise, the abutment 59 will engage against a second side of the pin 58 and prevent the sleeve 56 from turning past the expanded position. This construction restricts the movement of the spool 56 to 180° with respect to the hub 57 and this construction is ideally suited for a one-way drive or actuation.

Figure 7:
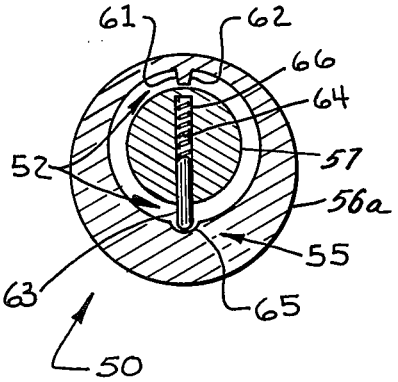
FIG. 7 is an end view in section of an alternative construction of the structure of FIG. 6.

FIG. 7 shows an alternative stop mechanism 52 which is constructed to enable the sleeve to turn either direction. This configuration is ideally suited for a two-way drive or actuation. In the stop mechanism 52, there is a groove extending about all the way around the sleeve **56*a* and there are a first abutment 61 and a second abutment 62. When the sleeve 56*a* rotates counterclockwise, the abutment 61 will engage a first abutment side of the pin 63 and when the sleeve 56*a* rotates clockwise, the abutment 62 will engage a second abutment side of the pin 63. In this embodiment, the sleeve is positively stopped at the position of maximum expansion and there is no provision for positively stopping at the non-expanded position. As shown, the pin 63 may be movably mounted and biased by a spring 64 into a recess 65 in the sleeve 56***a*. The recess 65 is located to index the sleeve 56*a* in the non-expanded position and in this respect the pin 63 doubles both as a pair of abutments and as the detent mechanism.

Further, the pin 63 may serve as the retainer to keep the sleeve 56*a* on the hub. As is apparent, the sleeve 56*a* cannot be removed while the pin 63 projects outwardly from the hub 51. However, if the pin 63 is pushed completely into the socket 66, the sleeve can then be withdrawn off of the hub 57. Also, the sleeve 56*a* can be installed onto the hub 57 by pressing the pin 63 into the socket 66.

The specific constructions set forth are my best embodiments but I suspect other configurations of my invention to be possible. The chucks 10, 40 and 50 are intended to be rotated but they need not do so in order to work; it is possible for the hub to be stationary and still function as a chuck to hold a work piece stationary.

Referring back to FIG. 1 wherein a roll 14 of paper is shown being grasped by the chuck 10, the opposite and not shown end of the roll 14 is preferably supported by some type of a well known and conventional centering device such as a live center (not shown) which will push the roll 14 axially against the chuck 10 and also support the not shown end of roll 14. Such end support of a roll may also be utilized with the chucks 40, 50 of FIGS. 4 and 5.

This invention is an extremely compact and efficient construction; it may be economically manufactured of metal, plastic or other materials. It is ideally suited for service in extremely hostile environments. The invention is thought to be most useful in tensioning devices but also to be useful in drive mechanisms as well as stationary chucking devices.

Therefore, even although various minor modifications may be suggested by those versed in the art or fields to which this invention is directed, it should be understood that I wish to embody within the scope of the patent warranted hereon, all such embodiments as reasonably and properly come within the scope of my contribution to the art.

I claim as my invention:

1. An expandable internal chuck for holding an item in a machine by expansion of the chuck within the item, comprising (a) an internal hub having
  (1) a central axis,
  (2) means for mounting of the hub to a machine, and
  (3) an external radial bearing having an axis at an acute oblique angle to the central axis of the hub;

(b) a sleeve mounted upon the radial bearing and rotatable with respect to the hub and having
  (1) an outer cylindrical surface, and
  (2) an inner journal positioned at an acute oblique angle to the outer cylindrical surface, said journal being closely fitted on said bearing; and (c) means for retaining the sleeve rotatably mounted upon the hub, with the hub and sleeve having
  (1) a non-expanded first position with respect to one another wherein the sleeve outer cylindrical surface is substantially concentric with the hub central axis, and
  (2) an expanded position in which the sleeve is rotated on and with respect to the hub from the first position to a second position in which the sleeve outer cylindrical surface is at an acute oblique angle to the hub central axis thereby expanding the effective diameter of the chuck for holding an item placed upon the chuck.

2. A chuck according to claim 1, in which the chuck is rotatable about the hub central axis, and in which the sleeve, when in the expanded position, defines an effective diameter concentrically co-rotatable with the hub.

3. A chuck according to claim 1, in which the axis of the hub and the axis of the bearing surface intersect at the axial middle point of the bearing surface upon which the sleeve is mounted.

4. A chuck according to claim 1, in which the sleeve journal has an axis which intersects an axis of the sleeve outer surface at the axial middle point of the length of the sleeve.

5. A chuck according to claim 1, in which the bearing surface is a cylindrical surface formed of the material of which the hub is made.

6. A chuck according to claim 1, in which the hub includes an axial thrust surface against which a one axial end of the sleeve faces.

7. A chuck according to claim 1, in which the hub has a radial shoulder adjacent to a one axial end of the sleeve, said radial shoulder being concentric to the sleeve outer cylindrical surface when the sleeve is in the non-expanded first position.

8. A chuck according to claim 7, in which the radial shoulder is of a diameter substantially the same as a diameter of the sleeve outer surface.

9. A chuck according to claim 7, in which the retainer has a radial shoulder adjacent to a second axial end of the sleeve, both radial shoulders being concentric with one another.

10. A chuck according to claim 1, in which the sleeve may rotate from the non-expanded first position to the expanded second position in either of a clockwise or counterclockwise direction with respect to the hub.

11. A chuck according to claim 1, including a seal on each end of the sleeve, said seals being operative for precluding free passage of environmental materials into the bearing and journal surfaces.

12. A chuck according to claim 11, in which said seals operatively contact axial end surfaces of the sleeve.

13. A chuck according to claim 1, including a resilient detent operatively mounted between the hub and the sleeve, said detent being operative for indexing the sleeve on the hub in the non-expanded first position.

14. A chuck according to claim 13, in which the detent is operatively disengageable in response to a predetermined torque applied between the hub and the sleeve.

15. A chuck according to claim 1, including a pair of abutments, one of the pair being on the sleeve and the other of the pair being on the hub, said abutments being engagable against each other for precluding the sleeve from turning past a position of maximum expansion.

16. A chuck according to claim 15, in which said abutments are engagable upon rotation of the sleeve in either of a clockwise or counterclockwise direction with respect to the hub.

17. A chuck according to claim 15, in which one of the abutments forms the sleeve retainer means.

18. A chuck according to claim 15, including a second pair of abutments, one of the second pair being on the hub and the other of the second pair being on the sleeve, the second pair being engagable for precluding the sleeve from turning past the first position in a single rotational direction with respect to the shaft.

19. A chuck according to claim 15, in which one of said abutments is also a resilient detent operable for indexing the sleeve in the non-expanded first position with respect to the hub.

20. A chuck according to claim 19, in which said abutment operative as a detent also comprises the sleeve retainer means.

21. A chuck according to claim 1, in which the sleeve has an outer surface diameter of less than the sleeve length.

22. A chuck according to claim 1, in which said hub is an elongate section of cylindrically shaped material having a diameter equal to a diameter of the bearing surface, said retaining means comprising at least one retainer ring mounted on said elongate section.

23. A chuck according to claim 22, including a pair of such retainer rings with the sleeve being between the rings.

24. A chuck according to claim 23, in which the rings are concentric to the bearing surface.

25. An expandable internal chucking device, comprising:

(a) a hub;

(b) means for mounting the hub to a machine tool and for rotating the hub about a central axis;

(c) an annular axial thrust surface on the hub and at an acute oblique angle to the central axis;

(d) an elongate member mounted to the hub and extending axially outward from the thrust surface, said elongate member being journaled for rotation about an axis perpendicular to said thrust surface; and (e) a cylindrical outer surface on said elongate member, said elongate member having a non-expanded first position in which the cylindrical outer surface is concentric to the hub central axis, said elongate member being rotatable with respect to the hub to an expanded second position in which the cylindrical outer surface is acutely oblique to the hub axis and in which second position an effective outer diameter of the chucking device is expanded for internally grasping an article to be chucked.

26. A chucking device according to claim 25, in which the axis of the cylindrical outer surface intersects with the axis upon which the elongate member is journaled at a mid-point along the length of the elongate member.

27. A chucking device according to claim 25, in which the elongate member has a pair of axial ends which are perpendicular to the axis upon which the elongate member is journaled.

28. A chucking device specifically for grasping the inside of a tubular article, comprising:

(a) a hub having a bearing surface;

(b) a tubular sleeve having an inner cylindrical surface mounted said bearing surface, said sleeve being rotatable about an axis of said bearing surface;

(c) means for mounting the hub to a rotatable machine tool with the axis of the bearing surface being at an acute oblique angle to an axis of rotation of the machine tool;

(d) a cylindrical outer surface on said sleeve, said outer surface having an axis at an acute oblique angle to an axis of said inner cylindrical surface; and (e) means for retaining said sleeve on said bearing surface; said sleeve and said hub being rotatable with respect to one another from a relatively non-expanded first position to a relatively expanded second position.

* * * * *